US008794471B2

(12) United States Patent
Bontrager et al.

(10) Patent No.: US 8,794,471 B2
(45) Date of Patent: Aug. 5, 2014

(54) CONTAINER WITH IMPROVED TAMPER EVIDENT STRUCTURE

(75) Inventors: Richard Louis Bontrager, Ripon, CA (US); Randall Glenn Strange, Manteca, CA (US); Joseph Michael Torquato, Hollister, CA (US)

(73) Assignee: Naturall Selection Foods, LLC, San Juan Bautista, CA (US)

( * ) Notice: Subject to any disclaimer, the term of this patent is extended or adjusted under 35 U.S.C. 154(b) by 75 days.

(21) Appl. No.: 13/530,480

(22) Filed: Jun. 22, 2012

(65) Prior Publication Data

US 2013/0341327 A1 Dec. 26, 2013

(51) Int. Cl.
*B65D 53/08* (2006.01)

(52) U.S. Cl.
USPC ..... 220/279; 220/214

(58) Field of Classification Search
CPC ..... B65D 553/08; B65B 7/00
USPC ..... 220/279, 276, 270, 675, 214
See application file for complete search history.

(56) References Cited

U.S. PATENT DOCUMENTS

| | | | | |
|---|---|---|---|---|
| 3,300,115 | A | 1/1967 | Schauer | |
| 4,759,463 | A | 7/1988 | Mazoin | |
| 2007/0012710 | A1 * | 1/2007 | Vovan | 220/793 |
| 2008/0308557 | A1 | 12/2008 | Kyle | |
| 2010/0113241 | A1 | 5/2010 | Hebert | |

* cited by examiner

*Primary Examiner* — Steven A. Reynolds
*Assistant Examiner* — King M Chu
(74) *Attorney, Agent, or Firm* — Meyer IP Law Group

(57) ABSTRACT

A container comprises a basket having a basket lip and a lid with lid lip connected to a tear strip, the tear strip being bonded to the basket lip to form a seal. An applied force to the seal separates the tear strip from the lid so that the tear strip remains bonded to the basket lip and so that a lid tear surface is exposed. The basket lip includes a basket snap feature and the lid lip includes a lid snap feature. The basket snap feature and the lid snap feature are mateable to resist separation of the lid from the basket.

16 Claims, 9 Drawing Sheets

CONTAINER WITH IMPROVED TAMPER EVIDENT STRUCTURE

TECHNICAL FIELD

This invention relates generally to packaging, and more particularly to packaging for fragile and/or perishable goods.

BACKGROUND

Plastic containers for holding perishable goods are ubiquitous in grocery stores and produce markets and can be found by consumers in a variety of shapes and sizes. For example, berries are sold in clear polyethylene terephthalate (PETE) clamshell containers holding anywhere from a half-pint to a quart or more of fruit. Such plastic containers can be opened by consumers at the point of sale and the goods contained within may be handled by multiple different people before purchase, leading to bruising and contamination that can degrade the quality of the goods. Consumers would generally prefer that the goods be inaccessible until purchased.

DETAILED DESCRIPTION OF THE DRAWINGS

Figure 1A:
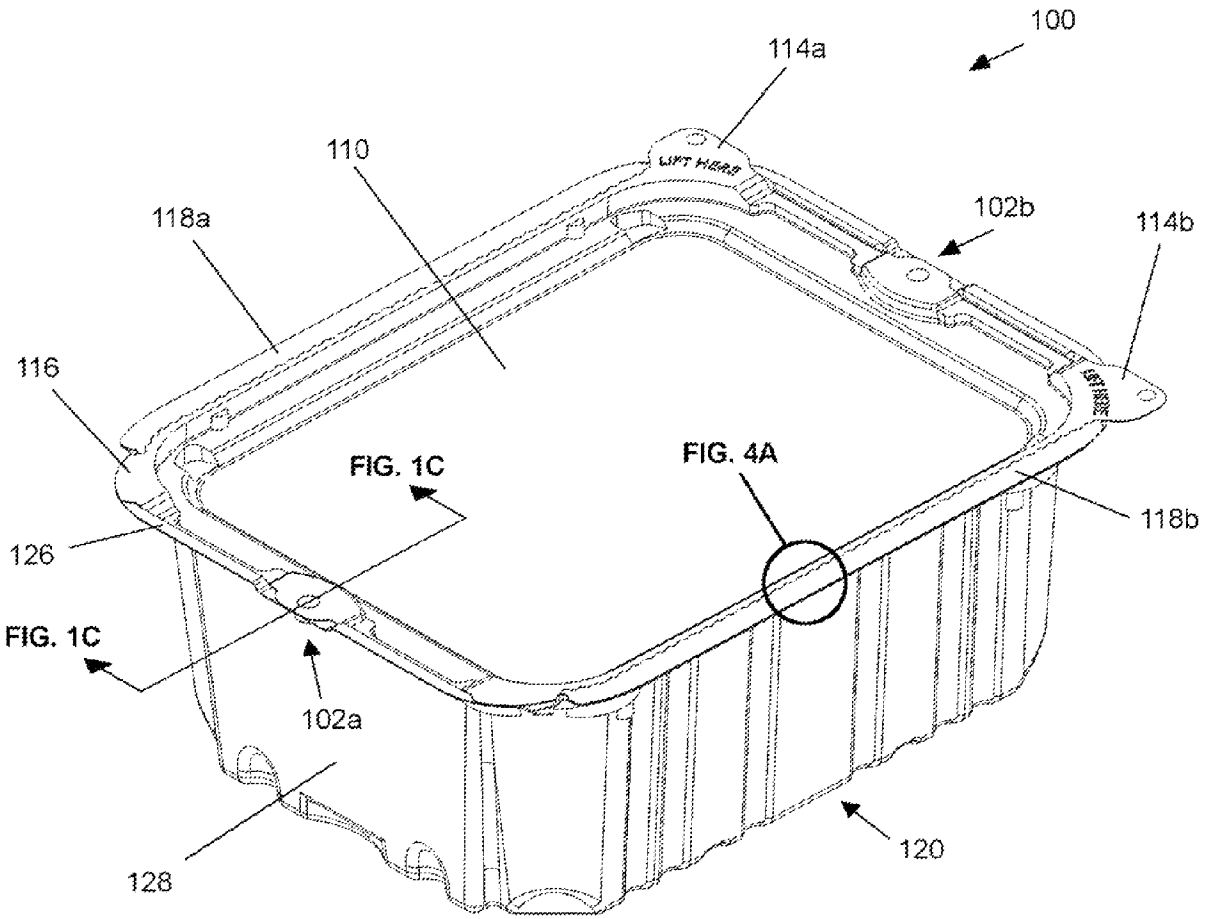
FIG. 1A is a perspective view of an embodiment of a container in accordance with the present invention.
Figure 1B:
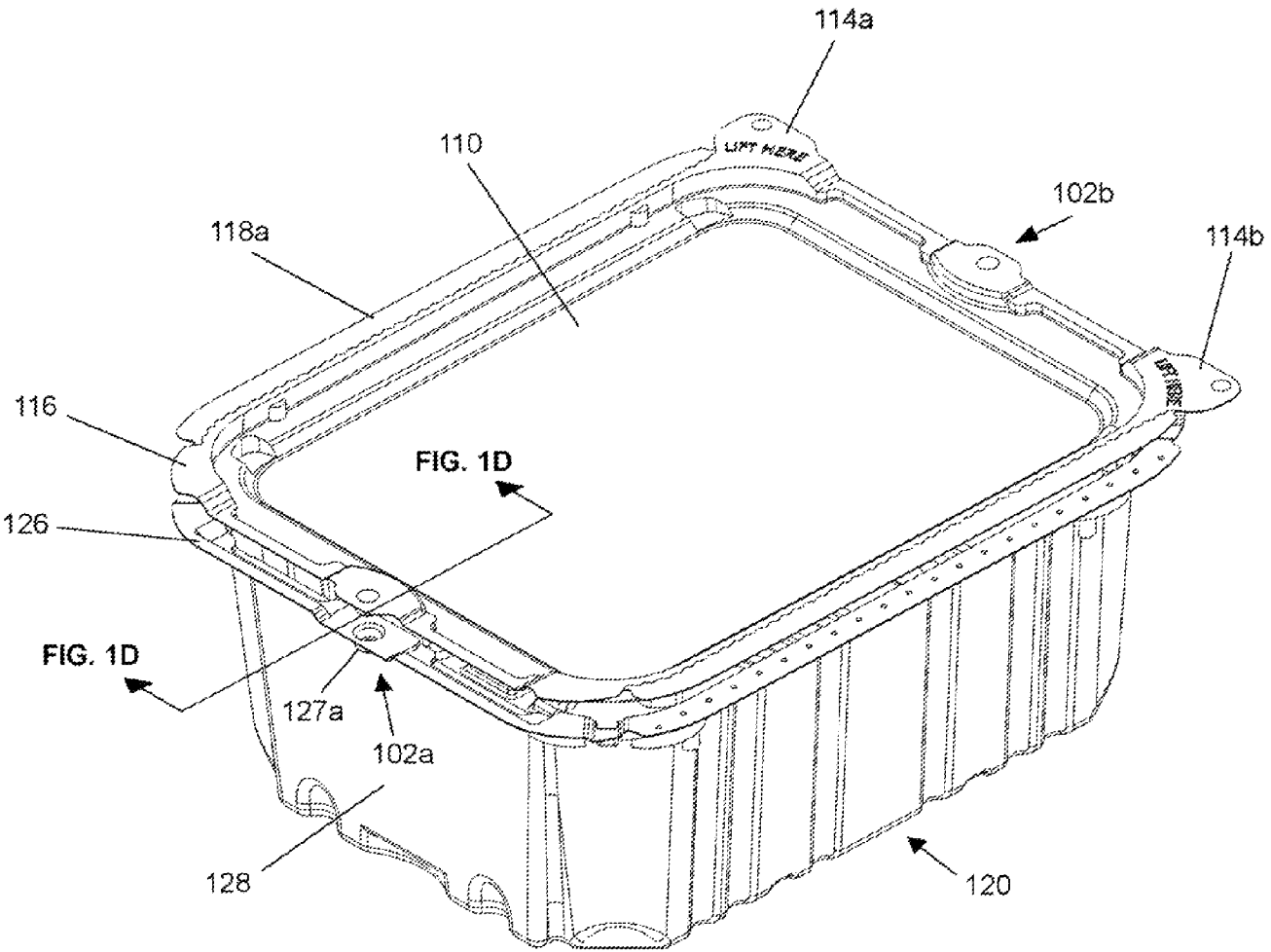
FIG. 1B is a perspective view of the container of FIG. 1A with a lid of the container separated from a basket of the container.

Referring to FIGS. 1A and 1B, an embodiment of a container 100 in accordance with the present invention is shown. The container 100 comprises a basket 120 defined at least partially by a base (121 in FIG. 5A) and a sidewall 128 extending from the base 121 to a basket lip 126. The base 121 can be concave, flat, or alternatively can have some other shape relative to a plane on which the basket 120 can rest, depending on a desired contact surface area, a desired flow of air along the base 121, etc. As shown, the base 121 has an approximately rectangular footprint across the plane on which it rests. The sidewall 128 extending from the base 121 has four faces. Alternatively, in other embodiments the footprint of the base can be some other shape, such as square, triangular or circular, for example, and the sidewall can have a number of faces defined by a shape of the base.

The container 100 further comprises a lid 110 that can be separated from the basket 120 to access goods within the basket 120. However, the lid 110 is fixedly mated with the basket 120 during shipping, and/or while offered for sale to consumers. Preferably, at least a portion of the container 100 is formed from transparent or semi-transparent polymer material so that a consumer can inspect goods within the container 100 without the need to access the inside of the basket 120. The lid 110 is fixedly mated with the basket 120 by a pair of tear strips 118*a*, 118*b* that extend along the length of the container 100. The basket lip 126 is bonded to the pair of lid tear strips 118*a*, 118*b* connected with the lid 110. The tear strips 118*a*, 118*b* must be detached from the lid 110 to separate the lid 110 from the basket 120 and access goods within the basket 120. The tear strips 118*a*, 118*b* protect the goods within the container 100 from damage and/or contamination, and provide tamper evidence to consumers.

Figure 2:
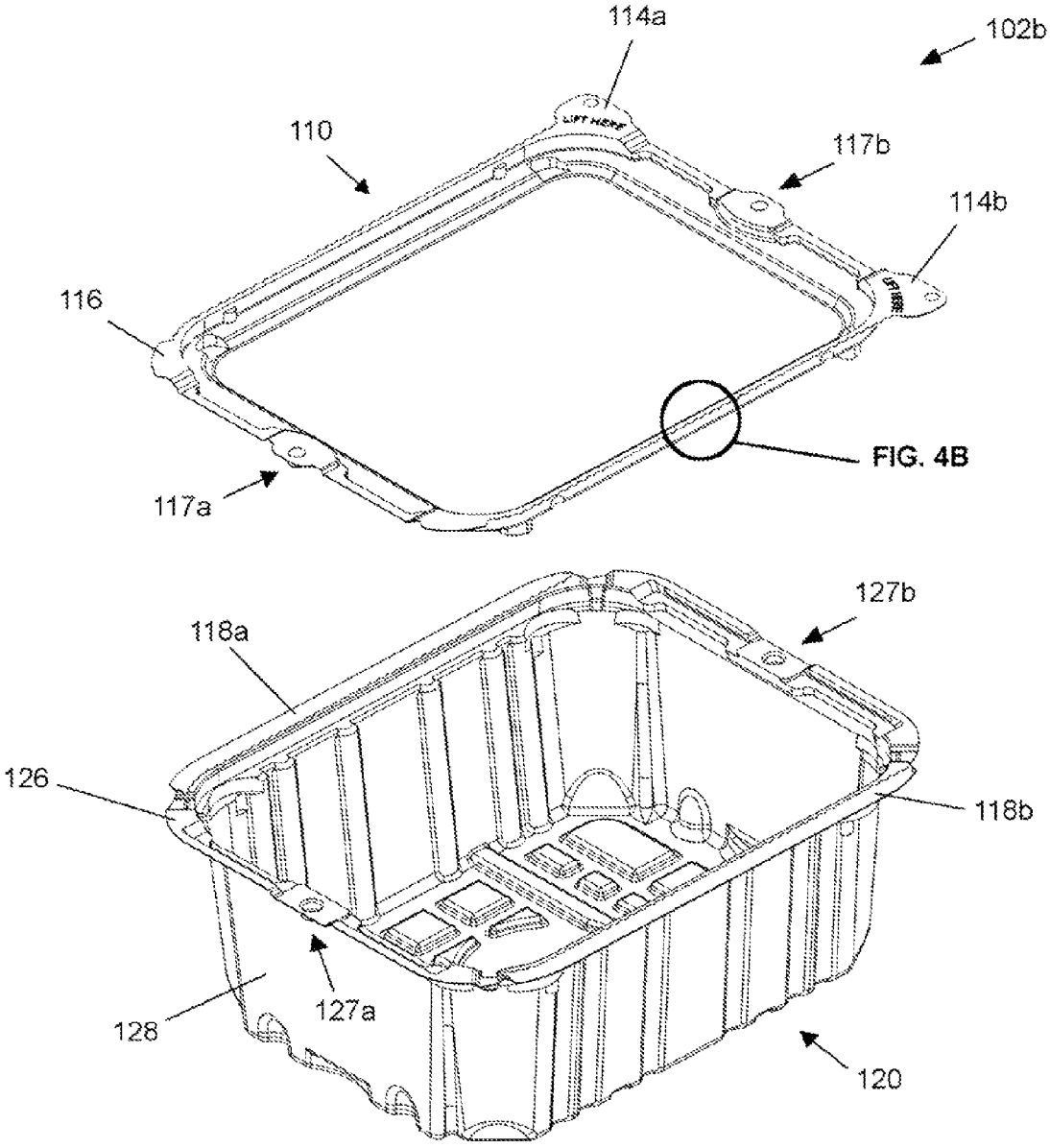
FIG. 2 is a perspective view of the container of FIG. 1A-1D with the lid, having been bonded to the basket, subsequently separated from the basket.

Referring to FIG. 2, the tear strips 118*a*, 118*b* extend along opposite sides of the container 100 and can be detached from the lid 110 by urging the lid 110 away from the basket 120 with sufficient force to separate the lid 110 from the tear strips 118*a*, 118*b* so that the tear strips 118*a*, 118*b*, bonded to the basket lip 126, remain attached to the basket lip 126. The lid 110 can be urged away from the basket 120, for example, by grasping tabs 114*a*, 114*b* extending from the lid 110 that provide sufficient surface area for average sized fingers to effectively grasp. Optionally, the grasping tabs 114*a*, 114*b* can include a dimple 117*a*, 117*b* or other protuberance to prevent slippage when grasping.

As will be appreciated by one of ordinary skill in the art upon reflecting on the teachings contained herein, the tear strips 118*a*, 118*b* need not be arranged as shown in FIGS. 1A-4C. For example, where the base is circular and the sidewall has a rounded shape, a single tear strip can extend around at least a portion of the periphery of the container. Myriad different container shapes and arrangements of tear strips can be applied while remaining within the scope of the present invention. The present invention is not intended to be limited to those shapes and tear strip arrangements shown in FIGS. 1A-4C.

The container 100 of FIGS. 1A-1D further comprises a snap feature to resist separation of the lid 110 from the basket 120. Two ends of the container 100 each include the snap feature 102*a*, 102*b*, and can supplement the tear strips 118*a*, 118*b* in preventing tampering or contamination of the products in the basket 120 by resisting separation of the lid 110 from the basket 120 at the ends, which in the embodiment shown are not bonded. The snap features 102*a*, 102*b* can also provide a way of reseating the lid 110 to the basket 120 once the lid 110 has been separated from the tear strips 118*a*, 118*b*, while providing at least some of the resistance to separation of the lid 110 from the basket 120, which resistance is no longer provided by the tear strips 118*a*, 118*b* upon initial separation.

Figure 1C:
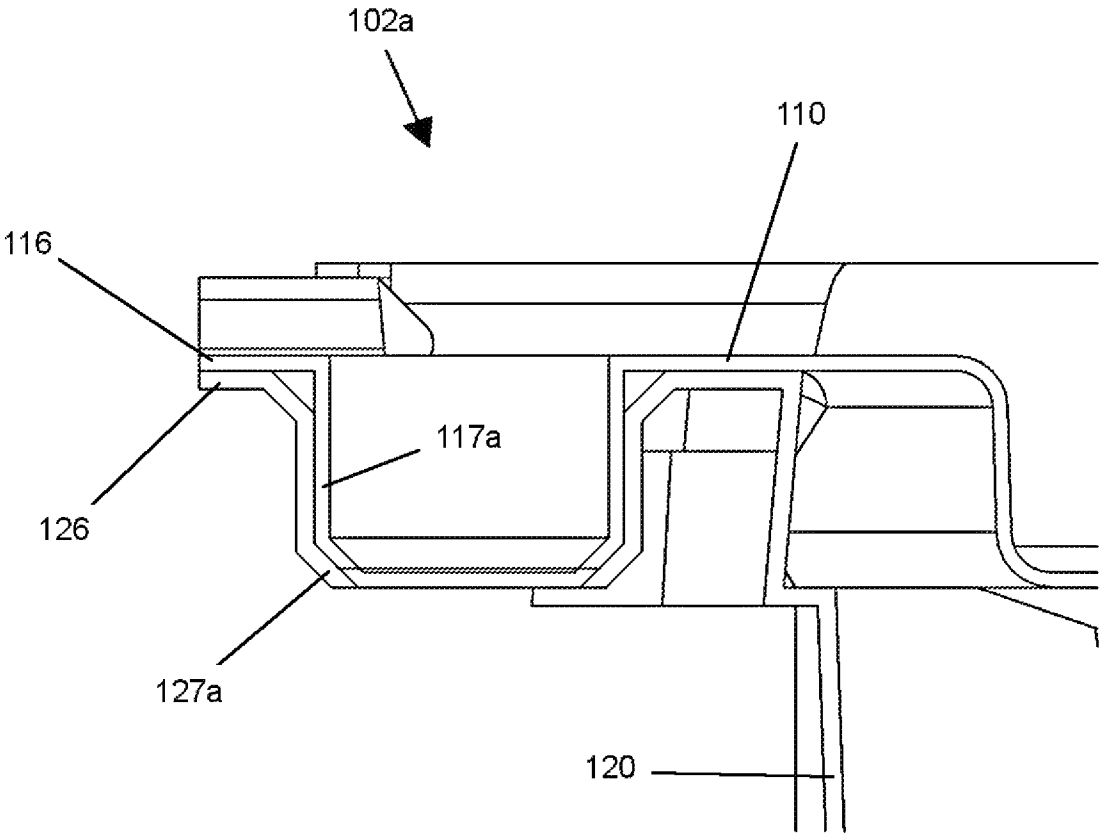
FIG. 1C is a cross-sectional view of a snap feature of the container to resist separation of the lid from the basket, the feature being shown with the lid seated on the basket.
Figure 1D:
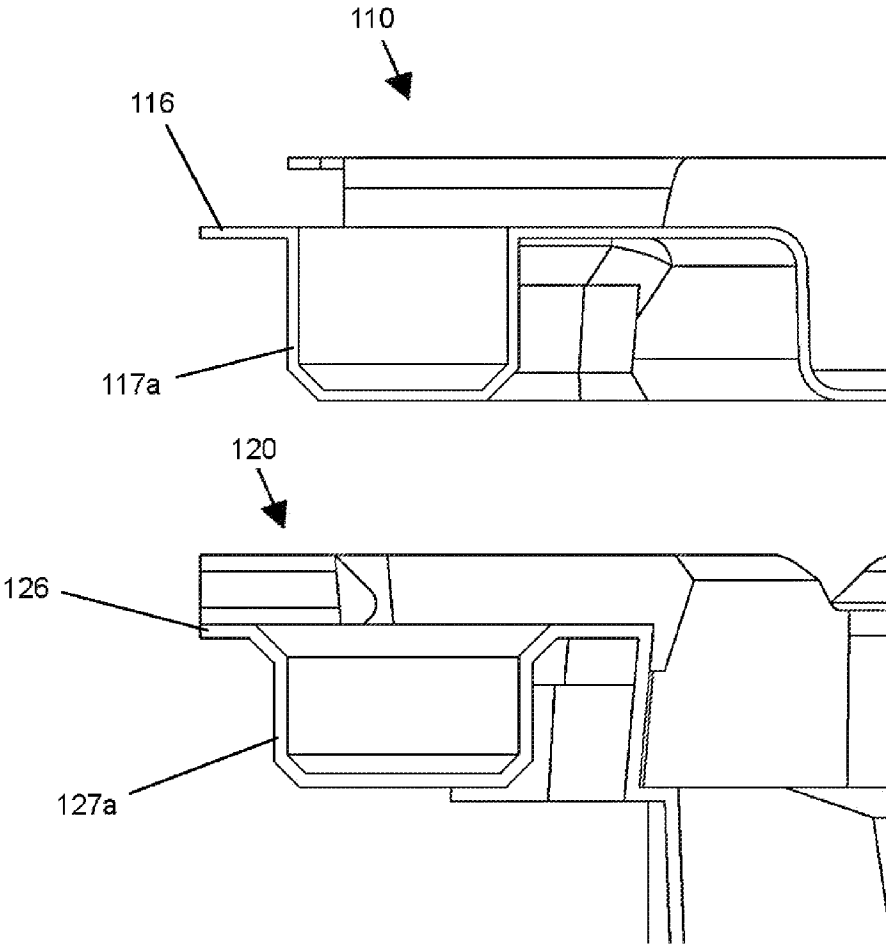
FIG. 1D is a cross-sectional view of the snap feature of FIG. 1C shown with the lid separated from the basket.

FIGS. 1C and 1D are cross-sectional views of one of the snap features 102*a* of the container 100. The snap feature 102*a* includes a lid button 117*a* formed in a lip 116 of the lid 110 and a basket button 127*a* formed in the lip 126 of the basket 120. As shown, when the lid 110 is mated with the basket 120, the lid button 117*a* is nested within the basket button 127*a*. Preferably, a friction or interference fit is formed between the lid button 117*a* and the basket button 127*a*, although in other embodiments, the buttons 117*a*, 127*a* can include some other mechanism for mating and resisting separation, such as a catch-and-latch mechanism. Further, in other embodiments the buttons can be formed in an upward fashion so that the basket button is nested or otherwise received within the lid button when the lid and basket are mated. In still other embodiments, the buttons need not be cylindrical, but rather can have some other shape, such as rectangular.

Figure 3A:
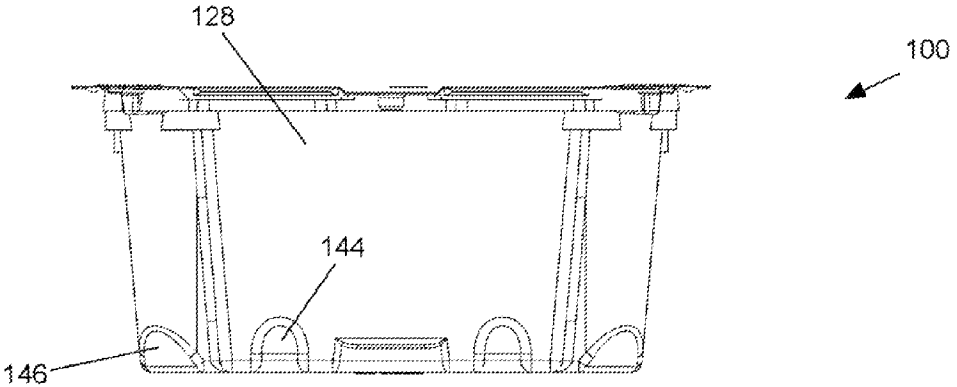
FIG. 3A is an end view of the container of FIG. 1A-1D.
Figure 3B:
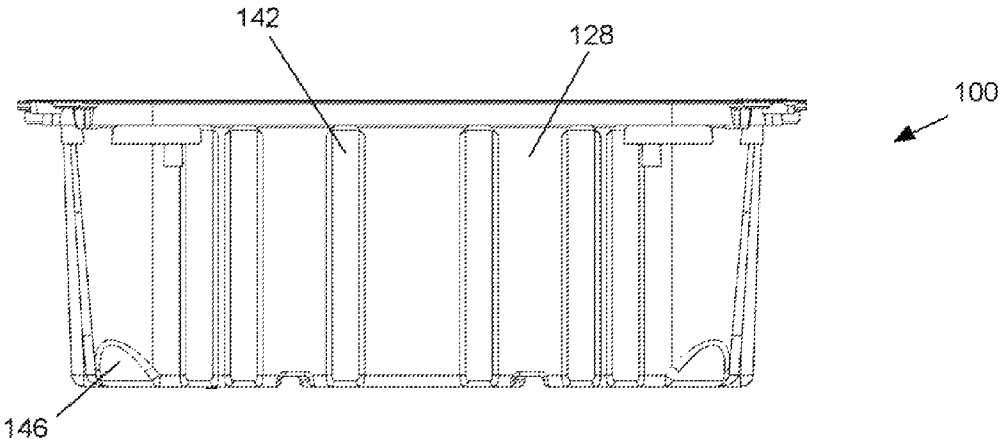
FIG. 3B is a side view of the container of FIG. 1A-1D.

Referring to FIGS. 3A and 3B, the sidewall 128 connecting the base 121 with the basket lip 116 has a simple draft that has a slight angle from perpendicular relative to a plane on which the container 100 sits. A draft can assist in ejection or removal of a basket from a mold. Further, the draft can sufficiently reduce a footprint of the base 121 such that the base 121 can be received on the lid of a second container without interference from a lip of the lid (if the lip is made to protrude above the resting surface of the lid). Alternatively, the sidewall 128 can include a compound draft from the basket lip 116 to the base 121. A compound draft includes two or more angles between the base 121 and the basket lip 116. The draft can be varied to suit manufacturing or to selectively adjust a volume of the basket. A sharper draft decreases basket volume, but can aid in manufacturing by easing ejection of the basket from a mold. In other embodiments, the sidewall 128 need not include a draft from the basket lip 116 to the base 121, or can include a compound draft including more than two angles. In still further embodiments, one face of the sidewall 128 can include no draft, or a draft having a different angle when compared with that of another face of the sidewall 128.

The sidewall 128 further includes features integrally formed during the molding process to improve sidewall strength. The end faces of the sidewall 128 include dimples 144 where the base 121 meets the sidewall 128 to strengthen the end faces. The side faces of the sidewall 128 include arcuate protrusions 142 extending inward toward the basket and resembling pillars. In other embodiments, the protrusions can extend outward away from the basket. Baskets having integrally formed protrusions and recessions can be referred to as semi-smooth-walled baskets. The dimples 144, and protrusions 142 can increase rigidity and strengthen the sidewalls 128 against compressive forces. Increasing compressive sidewall strength can allow the container to be formed with a thinner sidewall, thereby reducing manufacturing costs. Alternatively, increasing compressive sidewall strength can allow greater protection to goods within the container and improve stackability of containers. The corners of the sidewall are further strengthened by forming facets 146 extending from the base 121 to the rounded corners of the sidewall. It should be noted that embodiments of containers in accordance with the present invention need not necessary include sidewall features, or the sidewall can include features of different number and shape. For example, embodiments of containers in accordance with the present invention can comprise baskets having smooth sidewalls which are generally featureless. Use of smooth sidewalls reduces the number of contactable edges, but can result in a sidewall having less rigidity when compared with a semi-smooth-walled basket. Sidewall strength can be increased by increasing a thickness of the sidewalls. One of ordinary skill in the art will appreciate the myriad different shapes including or excluding drafts with which the sidewall 128 extending from the base 121 to the basket lip 116 can be formed. Embodiments of baskets in accordance with the present invention are intended to be applied to all such shapes without necessary differentiation.

Embodiments of containers in accordance with the present invention can include a tear strip scheme such as taught in U.S. patent application Ser. No. 12/885,362 to Bontrager et al., filed Sep. 17, 2010 and entitled "CONTAINER WITH IMPROVED TAMPER EVIDENT STRUCTURE." Referring to FIGS. 2 and 4A-4C, preferably, embodiments of containers 100 in accordance with the present invention can include a different tear strip scheme. In the scheme, tear strips 118*a*, 118*b* are connected with the lid lip 116 by a plurality of links 140 and bonded with the basket lip 126. The outer edges of the lid lip 116 are undulated so that they resemble waves. The outer edges of the tear strips 118*a*, 118*b* complement the outer edges of the lid lip 116. The links 140 are arranged within troughs 144, or wells of the outer edges of the lid lip 116. These notches are arranged between crests 146 of the outer edges of the lid lip 116. When the links 140 are severed, the tear strips 118*a*, 118*b* are detached from the lid lip 116, exposing the outer surface of the lid lip 116. Chaff 142 (also referred to herein as remainders) from the disconnected links remains connected to the lid lip 116; however, the chaff 142 does not extend beyond the crests 146 of the outer edges of the lid lip 116. The crests 146 are formed sufficiently close together that a finger or thumb, for example, brushed against the exposed outer edge of the lid lip 116 likely is not impeded by the chaff 142, making the outer edge feel relatively smoother when compared with a straight edge. This arrangement can reduce the risk of cuts to fingers or thumbs while providing a technique for unsealing the container with low force. The tear strips 118*a*, 118*b* are intended to remain in position, bonded with the basket lip 126.

While the outer edges of the lid lip 116 are shown in FIGS. 1A-5C having an undulating shape resembling waves, in other embodiments, the outer edges can have some other shape. The outer edges of the lid lip need only have a shape with alternating protruding and receding features. Thus, for example, in some embodiments, the outer edges of the lid lip can be scalloped so that a series of rounded protrusions alternate with notches formed by deep grooves, with the links extending from the grooves. In still other embodiments, the outer edges of the lid lip can include L-shaped features with links beings connected within the L-shaped features. One of ordinary skill in the art, upon reflecting on the teaches provided herein, will appreciate the myriad different shapes which the outer edges of the lid lip can have to reduce contact with chaff formed when detaching the lid lip from the tear strip. The present invention is not intended to be limited to the forms shown in FIGS. 1A-5C.

Figure 4A:
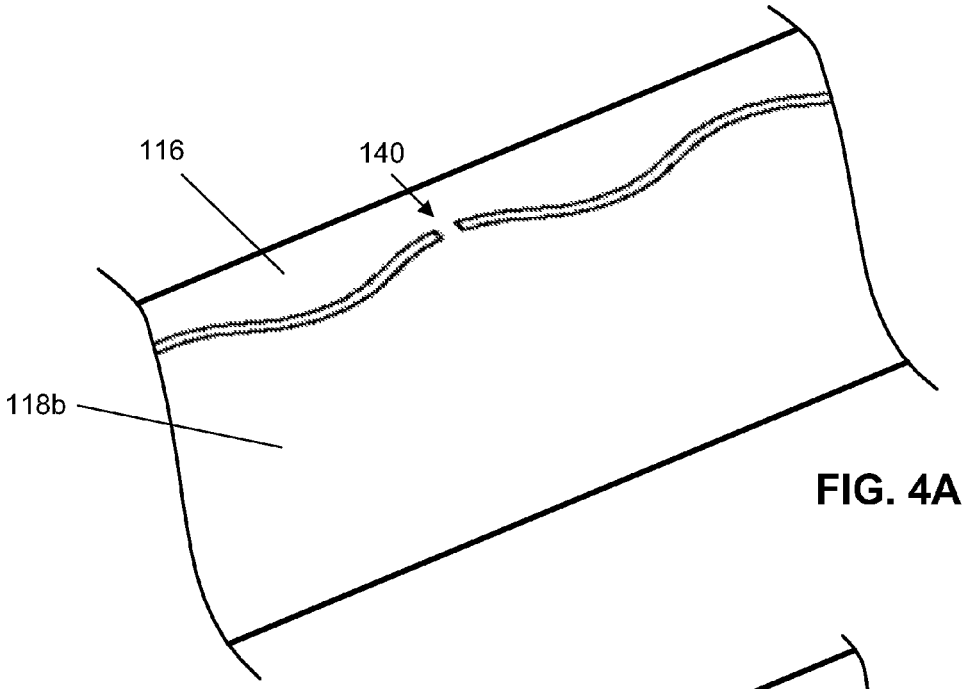
FIG. 4A is a detail view showing a tear strip connected with the lid lip.
Figure 4B:
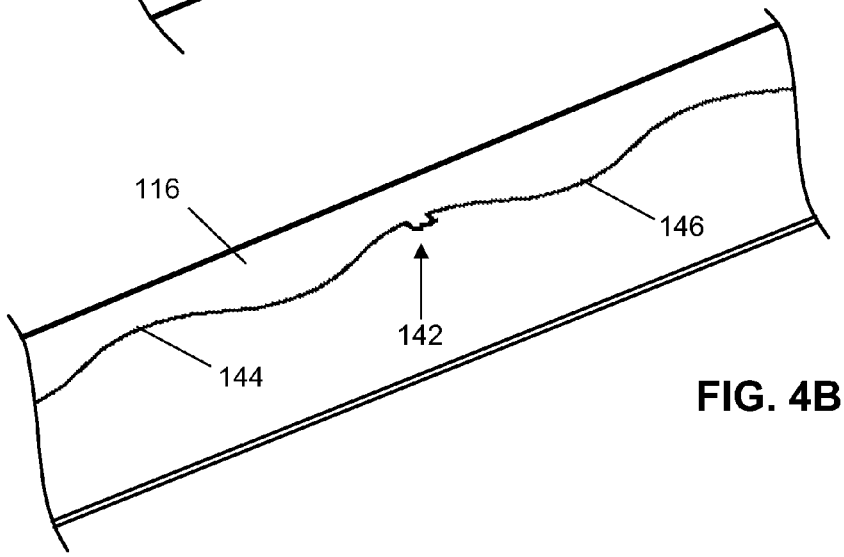
FIG. 4B is a detail view showing the tear strip disconnected from the lid lip.
Figure 4C:
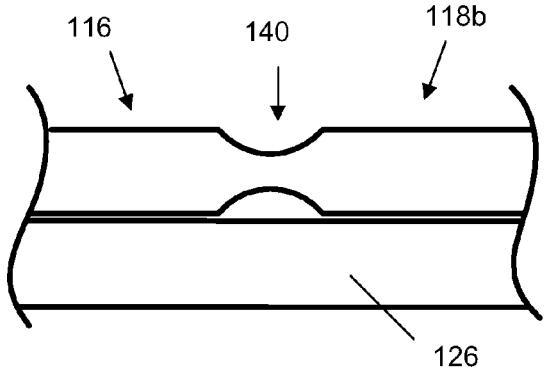
FIG. 4C is a side view of a link connecting the tear strip with the lid lip and the tear strip bonded to the basket lip.

Referring to FIGS. 4A and 4B, a force required to detach the lid lip 116 from the tear strips 118*a*, 118*b* can be reduced by staggering links 140 so that links 140 occupy every other trough 144 of the lid lip 116. Alternatively, links can be included in each trough of the lid lip, every third trough of the lid lip, or with any other frequency, whether the frequency is consistent along the tear strip or not. The force required to detach the lid lip from the tear strips can be tuned based on the pattern of linkage between the lid lip and tear strips. I Referring to the cross-section of FIG. 4C, the links 140 can optionally be kiss-cut so that the links 140 are thinner than the tear strips 118*a*, 118*b* and lid lip 116. Kiss-cutting the links 140 reduces the force required for detachment and also encourages the tear strips 118*a*, 118*b* to detach relatively cleanly along the links 140.

As mentioned previously, the container is filled with goods, the lid is mated with the basket, and the tear strips are bonded together to protect the goods and provide evidence of tamper. Currently perishables such as fruits and vegetables are placed in containers that are formed separately and delivered to a facility for packing Typically, such containers are clamshell containers that are hinged, and therefore can be opened after the fact so that the basket can be accessed for filling. Embodiments of methods in accordance with the present invention include partially forming a container, packing the container with a perishable good, and completing the container by bonding the lid to the basket.

In an embodiment, the tear strips 118*a*, 118*b* are bonded to the basket lip 126 by ultrasonically sealing the tear strips 118*a*, 118*b* to the basket lip 126. Ultrasonic sealing can be applied to form welds that bond the tear strips 118*a*, 118*b* and basket lip 126 together. However, the tear strips need not be bonded by ultrasonic sealing. For example, in other embodiments the tear strips can be bonded by adhesively sealing the tear strips to the basket lip. In other embodiments, the tear strips can be bonded by heating the tear strip and the basket lip so that one or both at least partially melts, and cooling the tear strip and basket lip.

Figure 5A:
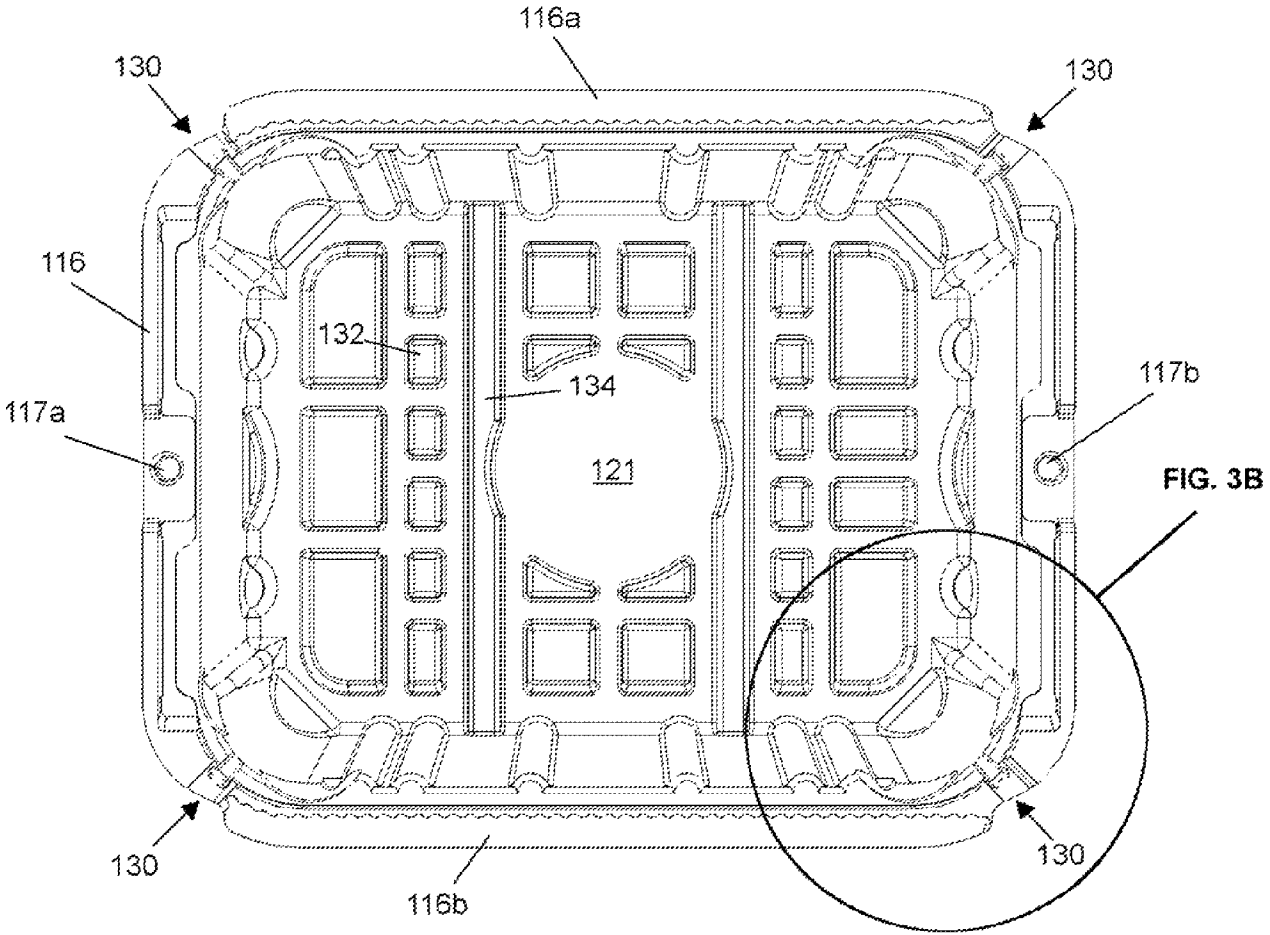
FIG. 5A is a top view of the basket of the container of FIG. 1A-1D.
Figure 5C:
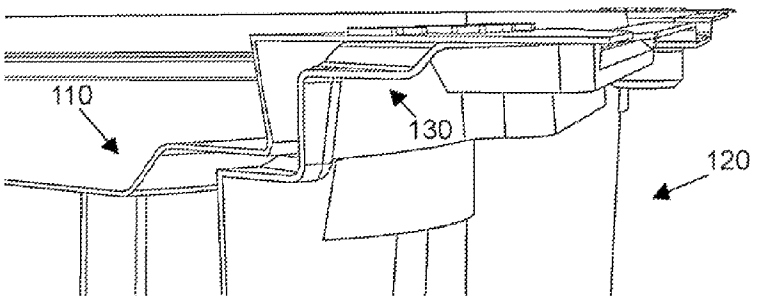
FIG. 5C is a cross-sectional view of the feature of FIG. 3B shown with the lid seated on the basket.
Figure 5B:
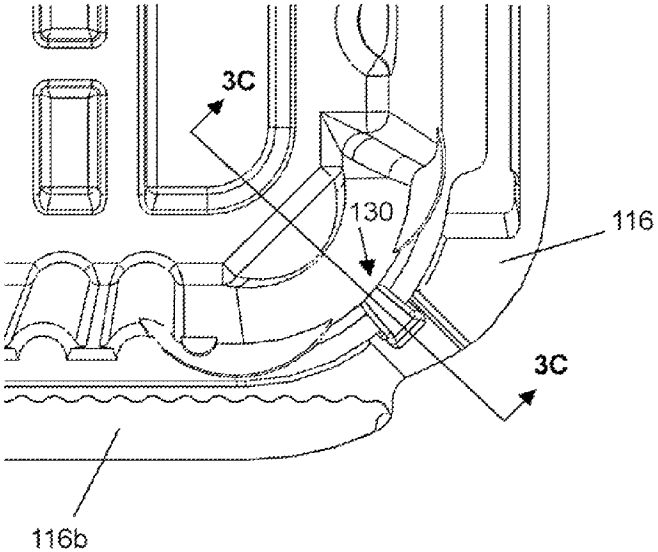
FIG. 5B is a top view of a feature of the container to vent the container of FIG. 1A-1D when the lid is seated on the basket.

Referring to FIGS. 5A-5C, embodiments of containers 100 in accordance with the present invention can further comprise vents 130 formed between the lid 110 and the basket 120 that can allow an roughly controllable amount of air exchange between the container 100 and the environment. FIG. 5A is a top down view of the basket 120 separated from the lid so that vent 130 locations along the entire container can be appreciated. Note also that FIG. 5A illustrates a feature pattern of the base 121. The feature pattern generally includes a series of depressions (e.g., 132) formed into the basket 120 as well as a pair of grooves 134 that extend entirely across the base 121 between opposite faces of the sidewall to allow liquid and air to flow beneath the basket 120. FIG. 5B is a close-up view of the vent 130 showing a depression extending into the base lip 126 and a corner of the sidewall. FIG. 5C is a cross-section taken at the location indicated in FIG. 5B, but with the lid 110 seated on the base 120 to illustrate the channel formed between the lid 110 and base 120 to form a vent 130. As will be appreciated upon reflecting on the teachings herein, more or fewer vents can be formed. For example additional vents can be formed along the sides or ends of the container. Further, the vents can vary in size across the container, or across a line of containers. For example, the vent can be sized to provide the preferred amount of ventilation based on the produce the container is intended to hold.

As mentioned above, the container is preferably formed of at least partially of a transparent or semi-transparent material. In a preferred embodiment, the container can be formed from PETE. However, in other embodiments the container can be formed from any resin known in the art for manufacturing plastic containers. For example, the container can be formed from any of high density polyethylene (HDPE), polyvinyl chloride (PVC), low density polyethylene (LDPE), polypropylene (PP), polystyrene (PS), and polycarbonate. Alternatively, the container can be formed from a material other than plastic resin, for example the container can be formed from paperboard or a composite material such as fiber-reinforced polymer (FRP) or glass-reinforced plastic (GRP).

The foregoing description of the present invention has been presented for purposes of illustration and description. It is not intended to be exhaustive or to limit the invention to the precise forms disclosed. Many modifications and variations will be apparent to practitioners skilled in this art. The embodiments were chosen and described in order to best explain the principles of the invention and its practical application, thereby enabling others skilled in the art to understand the invention for various embodiments and with various modifications as are suited to the particular use contemplated. It is intended that the scope of the invention be defined by the following claims and their equivalents.

The invention claimed is:

1. A container, comprising:

a basket having a basket lip; and a lid with lid lip connected to a tear strip, the tear strip being bonded to the basket lip to form a seal;

wherein an applied force to the seal separates the tear strip from the lid so that the tear strip remains bonded to the basket lip and so that a lid tear surface is exposed;

wherein the basket lip includes a basket snap feature and the lid lip includes a lid snap feature;

wherein the basket snap feature and the lid snap feature are mateable to resist separation of the lid from the basket;

wherein the lid tear surface is connected with a tear strip surface by a plurality of links arranged along the lid tear surface and extending therebetween;

wherein the lid tear surface has a plurality of alternating projections and notches, the tear strip surface has a shape complementary to the lid tear surface, and each link extends between a notch of the lid tear surface and a complementary feature of the tear strip surface; and wherein chaff generated by the links when the lid is separated from the tear strip does not extend beyond the projections of the lid tear surface.

2. The container of claim 1, wherein the bonded tear strip and basket lip are ultrasonically sealed.

3. The container of claim 1, wherein the basket and lid are removably mateable after separation of the tear strip from the lid lip.

4. The container of claim 1, wherein the tear strip surface and the lid tear surface are scallop shaped.

5. The container of claim 1, wherein:

the basket has a base and four side walls, each side wall being configured such that the basket is in an upright position when arranged so that a side wall of the basket is supported by a horizontal surface; and the lid has four edges.

6. The container of claim 5, wherein:

the tear strip is a first tear strip and is connected with the lid along a first edge of the four edges; and further comprising:

a second tear strip connected with the lid along a second edge of the four edges opposite the first edge;

wherein the second tear strip is bonded to the basket lip to form a second seal.

7. A container adapted to contain perishable goods, comprising:

a basket having a basket lip; and a lid with a lid lip connected to a tear strip, the tear strip being bondable to the basket lip;

wherein the lid is configured such that when the tear strip is bonded to the basket lip, the lid lip is separable from the tear strip so that the tear strip remains bonded to the basket lip and the lid is removably mateable with the basket;

wherein the basket lip includes a basket snap feature and the lid lip includes a lid snap feature; and wherein the basket snap feature and the lid snap feature are mateable to resist separation of the lid from the basket;

wherein the lid lip is connected with the tear strip by a plurality of links arranged along the lid lip and extending therebetween;

wherein the lid lip has a plurality of alternating projections and notches, the strip has a shape complementary to the lid lip, and each link extends between a notch of the lid lip and a complementary feature of the tear strip; and wherein chaff generated by the links when the lid is separated from the tear strip does not extend beyond the projections of the lid lip.

8. The container of claim 7, wherein the bonded tear strip and basket lip are ultrasonically sealed.

9. The container of claim 7, wherein:

the basket has a base and four side walls, each side wall being configured such that the basket is in an upright position when arranged so that a side wall of the basket is supported by a horizontal surface; and the lid has four edges.

10. The container of claim 9, wherein:

the tear strip is a first tear strip and is connected with the lid along a first edge of the four edges; and further comprising:

a second tear strip connected with the lid along a second edge of the four edges opposite the first edge;

wherein the second tear strip is bonded to the basket lip to form a second seal.

11. The container of claim 7, wherein the tear strip and the lid lip are scallop shaped.

12. A container adapted to contain perishable goods, comprising:

a basket having a basket lip; and a lid with lid lip connected to a tear strip by a plurality of links arranged along the lid lip and extending between the lid lip and the tear strip, the tear strip being bondable to the basket lip;

wherein the lid lip has a plurality of alternating projections and notches, the tear strip has a shape complementary to the lid lip, and each link extends between a notch of the lid lip and a complementary feature of the tear strip;

wherein the lid is configured such that when the tear strip is bonded to the basket lip, the lid lip is separable from the tear strip so that the tear strip remains bonded to the basket lip; and wherein chaff generated by the links when the lid lip is separated from the tear strip does not extend beyond the projections of the lid lip.

13. The container of claim 12, wherein the tear strip and the lid lip are scallop shaped.

14. The container of claim 12, wherein:

the basket has a base and four side walls, each side wall being configured such that the basket is in and upright position when arranged so that a side wall of the basket is supported by a horizontal surface; and the lid has four edges.

15. The container of claim 14, wherein the tear strip is a first tear strip and is connected with the lid along a first edge of the four edges; and further comprising:

a second tear strip connected with the lid along a second edge of the four edges opposite the first edge;

wherein the second tear strip is bonded to the basket lip to form a second seal.

16. The container of claim 12, wherein the basket lip includes a basket snap feature and the lid lip includes a lid snap feature; and the basket snap feature and the lid snap feature are mateable to resist separation of the lid from the basket.

* * * * *